US005330231A

United States Patent [19]

Godfrey

[11] Patent Number: 5,330,231

[45] Date of Patent: Jul. 19, 1994

[54] GREETING CARD WITH PERSONAL IDENTIFIER AND METHOD OF PRODUCING

[76] Inventor: Phyllis M. Godfrey, 505 Seventh St., Hartford, Wis. 53027

[21] Appl. No.: 91,227

[22] Filed: Jul. 12, 1993

[51] Int. Cl.[5] ..... B42D 15/04; B42D 15/10

[52] U.S. Cl. ..... 283/78; 283/68; 283/77; 283/95; 283/106; 283/117; 40/124.1; 427/1; 462/1

[58] Field of Search ..... 283/68, 75, 78, 95, 283/106, 117, 77; 462/1; 40/124.1; 427/1, 260, 261; 446/147; 118/31.5

[56] References Cited

U.S. PATENT DOCUMENTS

| | | | |
|---|---|---|---|
| 2,010,830 | 8/1935 | Staudte | 283/117 X |
| 3,850,649 | 11/1974 | Buerkley et al. . | |
| 3,867,164 | 2/1975 | Orlando et al. | 283/78 X |
| 4,029,012 | 6/1977 | Smith III, et al. | 283/78 X |
| 4,360,548 | 11/1982 | Skees et al. . | |
| 4,699,077 | 10/1987 | Meadows et al. | 427/1 X |
| 4,705,299 | 11/1987 | Hedgcoth et al. | 283/78 X |
| 4,706,600 | 11/1987 | Mason, Jr. et al. | 118/31.5 |
| 4,879,134 | 11/1989 | Vassiliades | 118/31.5 X |
| 5,219,184 | 6/1993 | Wolf | 283/117 X |

FOREIGN PATENT DOCUMENTS

| | | | |
|---|---|---|---|
| 330770 | 9/1989 | European Pat. Off. | 427/1 |
| 50-16117 | 6/1975 | Japan | 283/78 |
| 2085985 | 4/1987 | Japan | 427/1 |
| 2119314 | 11/1983 | United Kingdom | 427/1 |

OTHER PUBLICATIONS

Jablonski "Fingerprint Receptor Coating" IBM Technical Disclosure Bulletin, vol. 18, No. 6, Nov. 1975, p. 1815.

*Primary Examiner*—Peter Dungba Vo

*Attorney, Agent, or Firm*—Andrus, Sceales, Starke & Sawall

[57] ABSTRACT

A personal identifier greeting card selected by a sender includes a treated paper-like sheet construction having a greeting printed thereon and a colorless developing solution adapted to be coated on an object such that when the treated sheet construction is placed in temporary contact with the coated object, the card will immediately develop a visible personal identifier image related to the sender of the card.

13 Claims, 1 Drawing Sheet

GREETING CARD WITH PERSONAL IDENTIFIER AND METHOD OF PRODUCING

FIELD OF THE INVENTION

This invention generally relates to the formation of visible images on substrates, and more particularly, pertains to the production of a greeting card having a visible personal identifier image formed thereon related to the sender of the card.

BACKGROUND OF THE INVENTION

Various attempts have been made to personalize or customize greeting cards, such as by incorporating personal identifiers such as distinctive scents, audible recordings, and photographs within the pages thereof. Such personal identifiers are typically accompanied by a printed greeting and a drawing in harmony with the theme of the greeting card as well as a further written message and/or a closing created by the sender. Other identifiers for customizing greeting cards with highly personalized images can also be contemplated such as by direct ink transfer, whereby one wets an object with ink and transfers a visible image directly to the greeting card. As should be appreciated, use of such ink transfer can be somewhat messy, and requires a certain amount of clean-up.

One known method for creating visible images as used in hospital identification involves transfer of an image of a human object wetted with a particular non-ink, instantaneous, developing solution to a specially coated form. It is this quick developing, clean and easy to use system upon which the present invention is motivated and designed to produce a greeting card with improved personalization.

Accordingly, it is especially desirable to provide a greeting card which offers a greater degree of customization and which will allow individuals to personally enhance their cards by quickly and easily reproducing images of human objects, such as footprints, handprints, or the like. It is further desirable to upgrade and supplement a greeting card in order to permit a recipient to frame and preserve the card as a keepsake.

SUMMARY OF THE INVENTION

The present invention advantageously provides an improved greeting card having a unique arrangement of appropriate greeting and personalized identifiers incorporated therein. The improved greeting card is relatively simple, affordable, and can be used for a variety of occasions as desired.

These and other advantages are realized in one aspect of the invention by a personal identifier greeting card as selected by a sender comprising a treated, paper-like sheet construction having a greeting printed thereon, and a colorless developing solution adapted to be coated on an object such that with the treated sheet construction being placed in temporary contact with the coated object, the card will immediately develop a visible personal identifier image related to the sender of the printed greeting.

In a highly preferred embodiment, the invention contemplates a laminated construction comprising an untreated outer sheet, a treated inner sheet having an aperture formed therein and a greeting printed thereon, with said outer sheet and said inner sheet joined together to form a pocket which will hold a photograph in the area of the aperture. A colorless developing solution is adapted to be coated on an object such that when the treated inner sheet is placed in temporary contact with the coated object, the card will instantaneously develop a visible personal identifier image related to the personalized greeting and photograph.

The invention also envisions a method for producing a personal identifier greeting card comprising the steps of supplying a treated paper-like construction having the greeting printed thereon as selected by a sender, coating an object with a colorless developing solution, and applying said coated object to the treated sheet construction such that when the coated object reacts with the treated sheet construction, the card will immediately develop a visible personal identifier image related to the sender of the printed greeting.

BRIEF DESCRIPTION OF THE DRAWINGS

The invention will become better understood by reference to the following detailed description of the with the appended drawing, wherein like numerals denote preferred exemplary embodiment when read in conjunction like elements and.

DETAILED DESCRIPTION OF THE PREFERRED EMBODIMENTS

Figure 1:
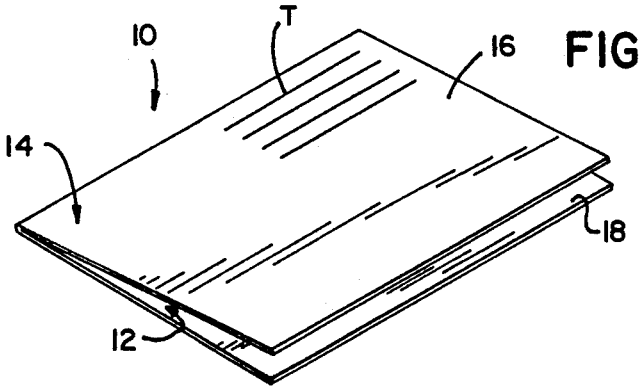
FIG. 1 is a perspective view of the greeting card embodying the present invention.
Figure 2:
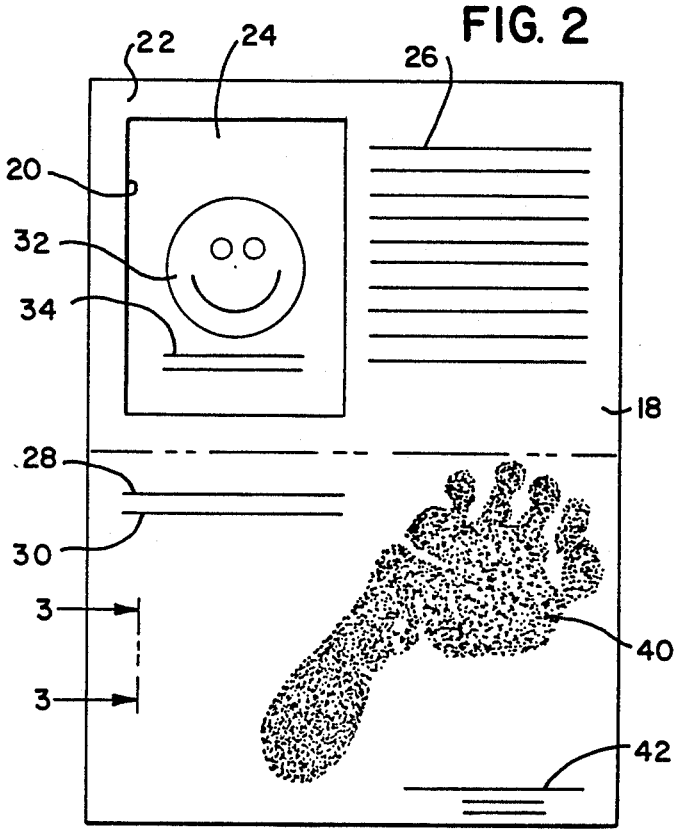
FIG. 2 is an elevational view of the inside of the greeting card.
Figure 3:
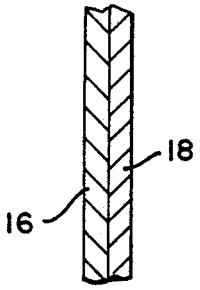
FIG. 3 is a cross-sectional view taken on line 3—3 of FIG. 2.
Figure 4:
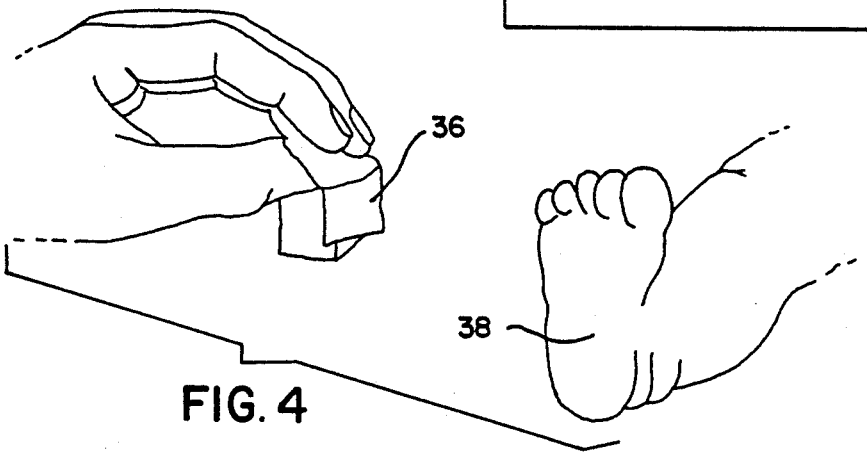
FIG. 4 is a view of a human foot being coated with a developing solution prior to transfer of the foot image to the greeting card.

A greeting card 10, according to the invention, is depicted in FIGS. 1-3. The card is conventionally folded, in this case about a horizontal line, to form an inside portion 12 and an outside portion 14. Optically readable information on the card includes text and may also include a pictorial depiction or design. Cards of this nature are typically available for sale in card shops, departments or catalogs where consumers randomly select a card bearing the sentiment and occasion they have in mind. The cards are sometimes sentimental and sometimes celebratory, the relationship between the sender and receiver affecting the form of message and content which will be acceptable.

Greeting card 10 preferably comprises an untreated outer sheet 16 and a treated inner sheet 18 joined together to form a laminated, paper-like construction. Inner sheet 18 includes an aperture 20 formed in the upper, inside portion, such aperture 20 together with outer sheet 16 defining a pocket 22 open at its top for inclusion of a photograph 24. Inner sheet 18 also includes a printed greeting 26 in harmony with the occasion for sending the card, a further written message 28, and a closing 30. The inside face of outer sheet 16 carries a facial representation 32 and a suitable notation 34 to locate photograph 24 in the area of pocket 22. The outside face of outer sheet 16 indicates the occasion for the card by text and/or pictorial design (not shown).

As a salient feature of the invention, greeting card 10 is produced with the aid of a special developing solution which is embodied within a towelette 36. The solution is colorless and constitutes a mixture of an alkyl ester of inorganic acid, an aromatic ester and colorformers. Such solution is designed to be wiped or rubbed on a selected portion of human skin or a human extremity 38 such as a hand or foot. Thereafter, the coated extremity 38 is placed in temporary contact against treated inner sheet 18, which includes a suitable reactant coating, such that card 10 will immediately develop a visible permanent, color image 40 of the transferred handprint or footprint related to photograph 24 and sender of printed greeting 26 on card 10. Card 10 also includes a dateline 42 for recording the date of the formed image.

Sheet material comprising treated inner sheet 18 as well as towelette 36 embodying developing solution are commercially sold together as the Identifier$^{TM}$ system by 3 M of St. Paul, Minn. Such solution is relatively odorless and exhibits a relatively low level of dermatological activity when applied for short applications, so as not to harm human extremities when wiped thereon.

It should be recognized that the present invention enhances the personalization of a greeting card and offers a further dimension in establishing the identity of a card sender without undue cost. In providing the latter, a permanent visible image is quickly, easily and clearly transferred from the sender to the recipient, the finished product being of upgraded quality suitable for framing as a keepsake.

While the invention has been described with reference to a preferred embodiment, those skilled in the art will appreciate that certain substitutions, alterations and omissions may be made without departing from the spirit thereof. For example, while the preferred form of the invention focuses upon a laminated construction, it should be apparent that a greeting card could be made simply from the treated inner sheet 18 and that the developing solution could be provided in another form other than the towelette 36. Also, it should be understood that the invention may be used in combination with other sensory identifiers, such as audible recordings and distinctive scents incorporated therein. Accordingly, the foregoing description is meant to be exemplary only and should not be deemed limitative on the scope of the invention set forth in the following claims.

I claim:

1. A method of producing a personal identifier greeting card wherein a printed greeting bearing a visible personal idetifier image of an object said object selectively transmitted by a sender, said method comprising the steps of:

supplying a treated sheet construction having a greeting printed thereon, said greeting being selected by a sender;

coating said object with a colorless developing solution; and applying said coated object to said treated sheet construction, said coated object reacting with said treated sheet construction to immediately develop said visible personal identifier image of said selected object selected by the sender of said printer greeting.

2. The method of claim 1, wherein said treated sheet construction includes a photograph.

3. The method of claim 1, wherein said developing solution is embodied in a treated towelette.

4. The method of claim 3, wherein the step of coating an object with a colorless developing solution comprises wiping a human extremity with said towelette.

5. A personal identifier greeting card assembly having a greater card bearing a visible personal identifier image selected by a sender of the greeting card, said card assembly comprising:

a treated sheet construction defining a greeting card having a greeting printed thereon; and a colorless developing solution adapted to be coated on said object, said treated sheet construction being placed in temporary contact with said coating object to immediately develop said visible personal identifier image of said selected object selected by the sender of the greeting card.

6. The greeting card assembly of claim 5, wherein said coated object is a selected portion of human skin.

7. The greeting card assembly of claim 5, wherein said developing solution has a relatively low level of dermatological activity.

8. The greeting card assembly of claim 5, wherein said visible personal identifier image is representative of human extremity.

9. The greeting card assembly of claim 5, wherein said visible identifier image is in color.

10. The greeting card assembly of claim 5, wherein said treated sheet construction includes a facial representation, said facial representation being associated with said printed greeting and said visible personal identifier image.

11. The greeting card assembly of claim 5, wherein said treated sheet construction comprises a single sheet.

12. The greeting card assembly of claim 5, wherein said treated sheet construction comprises at least two sheets joined together.

13. A personal identifier greeting card assembly having a greater card bearing a visible personal identifier image of a selected object said card assembly comprising:

an untreated outer sheet;

a treated inner sheet, having an aperture formed therein and having a greeting printed thereon, said outer sheet and said inner sheet being joined together to define a greeting card and to form a pocket aligned with said aperture, said pocket being adapted to contain a photograph; and a colorless developing solution adapted to be coated on said object, said treated inner sheet being placed in temporary contact with said coated object to immediately develop said visible personal identifier image of said selected object related to said photograph.

* * * * *

UNITED STATES PATENT AND TRADEMARK OFFICE

CERTIFICATE OF CORRECTION

PATENT NO. : 5,330,231

DATED : July 19, 1994

INVENTOR(S) : Godfrey

It is certified that error appears in the above-indentified patent and that said Letters Patent is hereby corrected as shown below:

CLAIM 1, Col. 4, Line 1, delete "printer" and substitute therefor ---printed---; CLAIM 5, Col. 4, Line 11, delete "greater" and substitute therefor ---greeting---; CLAIM 5, Col. 4, Line 18, delete "coating" and substitute therefor ---coated---; CLAIM 13, Col. 4, Line 43, delete "greater" and substitute therefor ---greeting---;

Signed and Sealed this

Eleventh Day of October, 1994

*Attest:*

*Attesting Officer*

Bruce Lehman

BRUCE LEHMAN

*Commissioner of Patents and Trademarks*